United States Patent [19]

Fischer et al.

[11] Patent Number: 4,467,181

[45] Date of Patent: Aug. 21, 1984

[54] ELECTRIC HOTPLATE

[75] Inventors: Karl Fischer, Am Gänsberg, D-7519 Oberderdingen; Felix Schreder, Oberderdingen, both of Fed. Rep. of Germany

[73] Assignee: Karl Fischer, Oberderdingen, Fed. Rep. of Germany

[21] Appl. No.: 411,458

[22] Filed: Aug. 25, 1982

Related U.S. Application Data

[63] Continuation-in-part of Ser. No. 177,873, Aug. 14, 1980, Pat. No. 4,348,581.

[30] Foreign Application Priority Data

Aug. 17, 1979 [DE] Fed. Rep. of Germany ..... 2933296

[51] Int. Cl.[3] ..... H05B 3/68

[52] U.S. Cl. ..... 219/451; 219/458; 219/463; 219/541; 339/95 D; 339/276 T

[58] Field of Search ..... 219/443, 447, 449, 451, 219/455–467, 541; 339/95 D, 276 T

[56] References Cited

U.S. PATENT DOCUMENTS

| | | | |
|---|---|---|---|
| 1,093,754 | 4/1914 | Ball | 219/458 |
| 1,174,367 | 3/1916 | Vogel | 219/451 X |
| 1,644,255 | 10/1927 | Kercher et al. | 219/464 |
| 1,998,308 | 4/1935 | Causse | 219/445 |
| 3,093,433 | 6/1963 | Ege | 339/95 D |
| 3,324,447 | 6/1967 | Pistey | 339/95 D |
| 4,052,117 | 10/1977 | Tengler et al. | 339/95 D X |
| 4,084,876 | 4/1978 | Dinger | 339/95 D |
| 4,122,330 | 10/1978 | Fischer | 219/449 |
| 4,153,833 | 5/1979 | Fischer | 219/449 |
| 4,303,295 | 12/1981 | Schreder | 339/276 T X |

FOREIGN PATENT DOCUMENTS

| | | | |
|---|---|---|---|
| 2000745 | 7/1971 | Fed. Rep. of Germany | 339/95 D |
| 2057645 | 5/1972 | Fed. Rep. of Germany | 339/95 D |
| 5453283 | 9/1977 | Japan | 338/95 D |
| 365848 | 11/1962 | Switzerland | 219/451 |

*Primary Examiner*—Volodymyr Y. Mayewsky
*Attorney, Agent, or Firm*—Steele, Gould & Fried

[57] ABSTRACT

An electric hotplate with a cast hotplate member has a downwardly-directed border on its outer periphery. The edge of a covering sheet centrally fixed to the hot plate by a hollow screw rests on the lower edge of the border. A covering sheet step is centered within the border. A moisture-proof closure is obtained through an interposed seal and insulation is provided by crinkled aluminum foil. The hot plate connecting leads are passed via an insulating member through the covering sheet which, peripherally displaced by 180°, faces a depression in the covering sheet, so that hot plates according to the invention can be stacked in a space-saving manner. The connecting leads are flexible and their ends are brought together in a common connecting member.

19 Claims, 19 Drawing Figures

FIG. 16
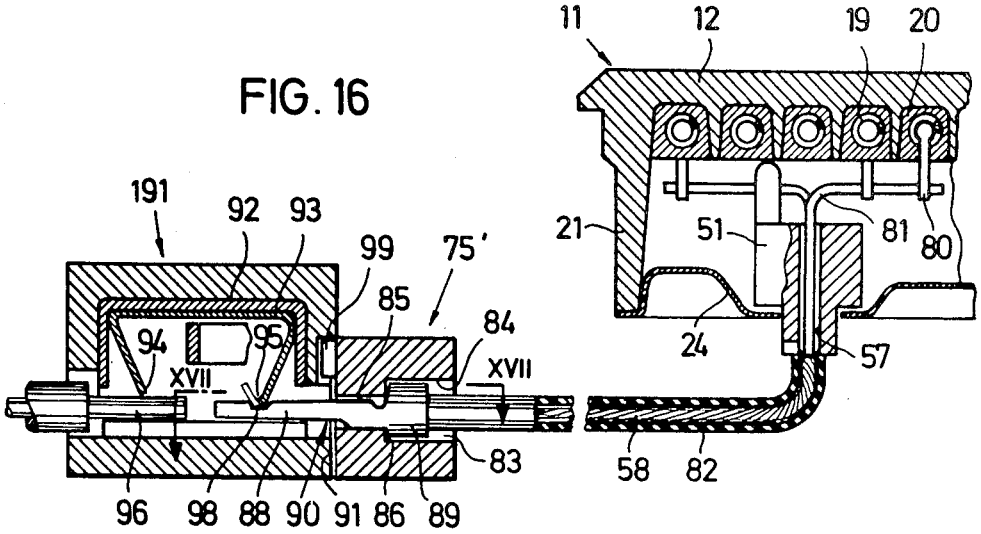
FIG. 17
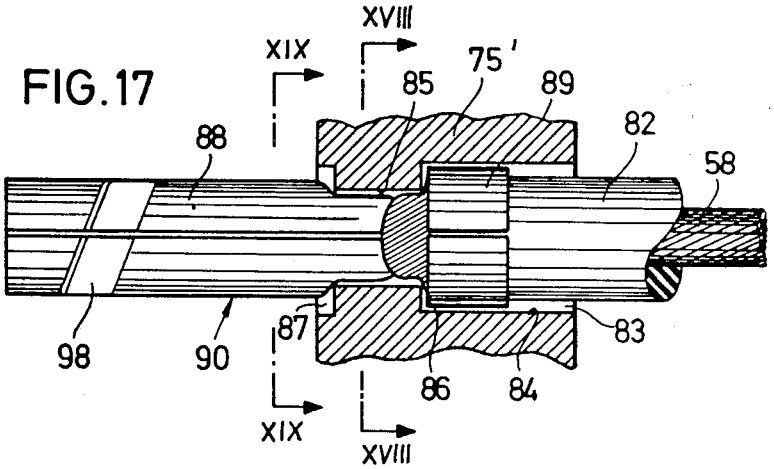
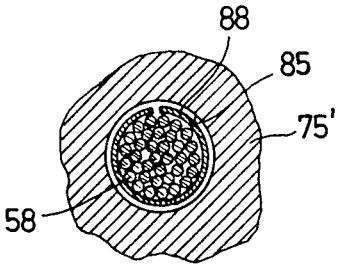
FIG. 18
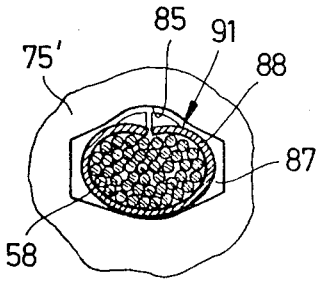
FIG. 19

ELECTRIC HOTPLATE

CROSS-REFERENCES

This application is a continuation-in-part of copending application Ser. No. 177,873 filed Aug. 14, 1980, now U.S. Pat. No. 4,348,581.

BACKGROUND OF THE INVENTION (1) Field of the Invention

The invention relates to an electric hotplate and more particularly to an electrical connection of the hotplate to a source of electrical energy.

(2) Description of the Prior Art

In applicants' U.S. Pat. Nos. 4,122,330 and 4,153,833 the electrical connection for the hotplate is provided by means of a ceramic connecting piece which is located at one end of a carrier sheet secured to a covering sheet covering the underside of the hotplate. An insulating member projects through the covering sheet and carrier sheet. Connecting leads in the form of solid, nonflexible bars or wires run through this insulating member and parallel to the carrier sheet and inside the connecting member. Supply lines can be fastened to the connecting member. Although the fixed arrangement of the connecting member has proved very satisfactory, it would nevertheless be desirable to improve the capabilities of installation, particularly in a hotplate of extremely flat construction, and to improve the storage and transport capabilities for hotplates of this kind.

Similar hotplates are shown and described in U.S. Pat. Nos. 1,644,255, 1,998,308 and in German Pat. Nos. 1,135,642 and 2,651,848 (corresponding to Australian Pat. No. 512,394). From U.S. Pat. No. 1,093,754 and German Pat. No. 904,672 it is known to provide insulated flexible connecting leads for electric hotplates. These leads have usually been very long and had single free ends. They were therefore awkward to handle, had to be shortened for fitting or else resulted in unnecessarily long leads which caused waste, made the installation complicated and gave rise to risks of short circuits, and also added to the variety of types of hotplates on the market, produced with different lengths of lead.

SUMMARY OF THE INVENTION

It is therefore proposed that the connecting leads with heat-resistant insulation coming out of the electric hotplate be made flexible and lead to a common connecting member, mounted in freely movable manner, the connecting leads being long enough to enable the connecting member to be mounted outside the region of the electric hotplate.

The proposed connecting member is flexible in movement and meets all the installation requirements but is located outside the heated area of the hotplate and yet does not get in the way when installed. For transporting and storage, the connecting member can be bent so that it takes up no more vertical space than the electric hotplate itself. It can either be folded outwards in the spaces formed between the round hotplates or can be folded inwards to rest in a recess in the covering sheet of the hotplate.

BRIEF DESCRIPTION OF THE DRAWINGS

The invention is described in greater detail hereinafter relative to preferred, but non-limitative embodiments of the invention and with reference to the attached drawings, wherein:

FIG. 16 shows a cross-section of a detail of a hotplate and its electrical connection to a supply line, FIG. 17 shows a section along the line XVII—XVII in FIG. 16 through a connecting member and the end of a flexible connection means, on a larger scale, and FIGS. 18 and 19 show sections along the lines XVIII—XVIII and XIX—XIX, respectively, in FIG. 17.

DETAILED DESCRIPTION OF THE PREFERRED EMBODIMENTS

Figure 1:
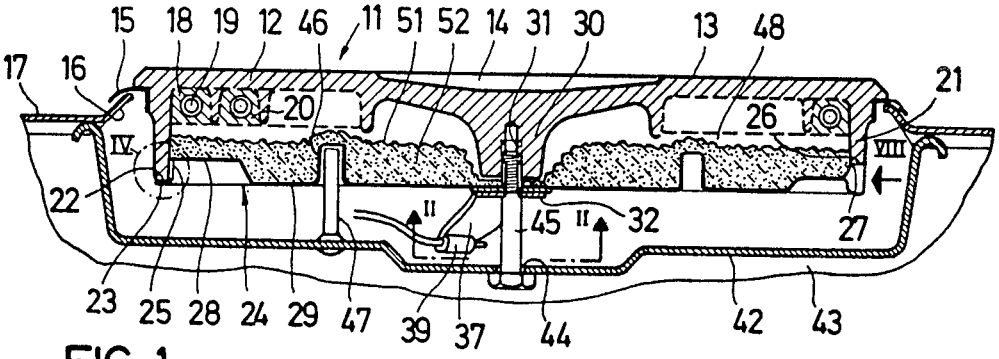
FIG. 1 is a cross section through an electric hotplate installed in an electric cooker, hob or the like, FIG. 2 is a detailed view, in section, along the line II—II in FIG. 1.

FIG. 1 shows an electric hotplate 11 comprising a hotplate member 12 consisting of cast iron with a flat, sealed, upper cooking surface 13. The unheated central zone 14 is recessed so as to form an annular cooking surface. At its outer periphery, the hotplate member engages over an overflow rim 15 consisting of sheet material of substantially U-shaped cross section, which rests on the raised rim 16 of the opening in the work plate 17 of a cooking appliance, e.g. an electric cooker or hob.

In the heated annular zone, the hotplate is provided with ribs extending in a spiral configuration which form between them spiral grooves 18 in which there are provided heating coils 19 embedded in a ceramics mass 20.

A downwardly directed, substantially cylindrical border 21 projects in the circumferential region of the hotplate member, while a flange-like border region of a cylindrical covering sheet 24 which is deformed and reinforced by embossed portions rests on the lower edge 22 of said border 21. The covering sheet has a border region 23 adjoined by a step 25 which is directed upwardly, i.e. towards the cooking surface, and which abuts on the inside of the border 21 and thus centers the covering sheet or cover.

Figure 8:
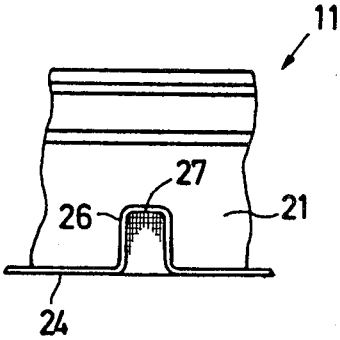
FIG. 8 shows a detail, viewed in the direction of the arrow VIII in FIG. 1.

At one point on its circumference, the border 21 has a recess 26 in the form of a rectangular cutout (FIG. 8) into which a corresponding embossed portion 27 of the covering sheet fits and thus prevents rotation of the covering sheet 24 on the hotplate member in spite of the relatively tight seal provided. For its part, the embossed portion 27 of the covering sheet ensures that the finished hotplate can be aligned in the circumferential direction when being handled during production. As a result, no inner projection on the border 21 is required.

Adjoining the step 25 is a region 28 of the covering sheet which is recessed relative to the border region 23 and adjoining said region 28 is a central region 29 which projects to some extent relative to the border region 23.

Figure 2:
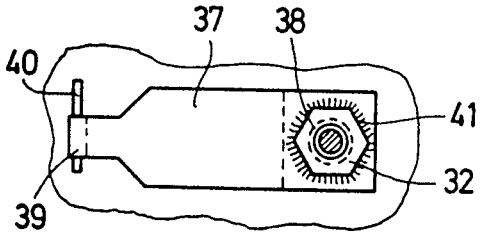
Figure 9:
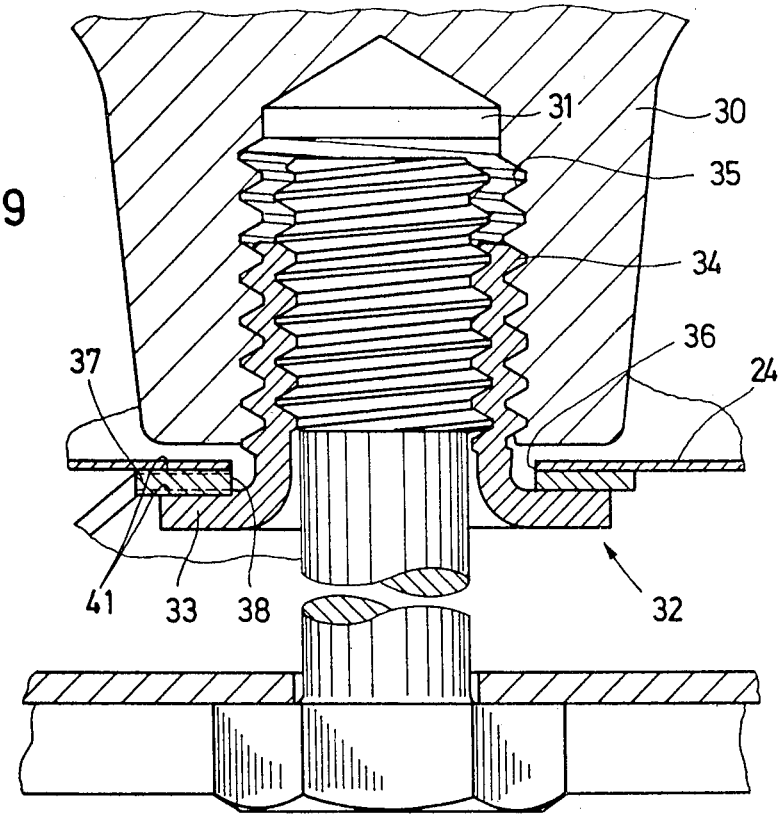
FIG. 9 shows an enlarged view of the detail showing the central fixing of the hotplate according to FIG. 1.

In the center of the unheated central zone 14, the hotplate member has a downwardly projecting pin 30 into which a threaded blind bore 31 is formed from below. A hollow cap screw 32, shown in detail in FIG. 9, is screwed into this threaded bore. This screw 32 consists of a stamped or deep-drawn sheet metal part with a flange-like cap region 33 with a hexagonal spanner surface or key faces and a sleeve-shaped threaded portion 34 adjoining the latter, into which an internal and external thread is pressed or forced. The screw 32 projects through a central hole 36 in the covering sheet 24 and is screwed into the thread 35 of the bore 31 so that the covering sheet 24 is pressed with its border region 23 against the lower edge 22 of the border 21 of the hotplate member 12. A sheet metal part 37 (FIG. 2) is interposed between the cap region 33 and the covering sheet. Sheet metal part 37 is in the form of a sheet metal strip having a hole 38 on one side, through which the screw 32 passes, while the other end tapers somewhat to a bent end 39 (FIGS. 1 and 2) which surrounds an earth lead 40. The earth lead may be pressed or welded on to the sheet metal part 37. Thus, this sheet metal part is simply placed under the screw head 33 like a washer and and provides a safe earth connection. It is particularly advantageous if the sheet metal part lies flat against the underside of the covering sheet 24 during production and shipping and is not bent away from the covering sheet until required. As a result, the earth connection does not substantially increase the height of the hotplate.

The left-hand side of FIG. 9 shows that the abutment surface or shoulder of the cap region 33 can be provided with a plurality of radial grooves 41. The sheet metal part 37 is correspondingly structured on its top and bottom, and so is the covering sheet 24 (cf. FIGS. 2 and 15), thus preventing the screw 32 from accidentally working loose. However, other securing methods may also be used.

The hotplate is held in the opening in the work plate which receives it by means of a bracket 42 which rests on the underside of the work plate 17 and has a flat U-shape. Its long back is reinforced by means of lateral bends 43. A cap screw 45 which is screwed into the internal thread in the hollow screw 32 projects through a hole 44 in the center of the bracket. In this way, the hotplate is clamped down by the screw and bracket and is securely fixed in position. This method of attachment uses only cap screws, which can easily be tightened using automatic screw drivers. The screw 32 is a simple stamped sheet metal part and the screw 45 is a simple machine screw. Until now, hot plates have been fitted with screw bolts which were screwed into the pins 30 and projected far beyond the underside of the hotplate. Two or more nuts screwed on to these bolts secured the covering sheet and hotplate to the bracket. Consequently, it was not possible to pack the hotplates in a space-saving manner. Now, however, the hotplate takes up only the room which its requires for itself when packed and there is the additional advantage that the length of the screw 45 can be selected according to the height of the bracket. This is particularly important if the hotplate is to be fixed in very flat built-in hobs. Thus, one type of hotplate can be used for brackets of all heights. Previously, the various types of hotplates had to be fitted with screw bolts of different lengths for this purpose.

Riveted to the bracket 42 is an upwardly projecting rod 47 which engages in a sleeve-like recess 46 formed inwardly in one piece with the covering sheet, and thus prevents the hotplate from rotaing relative to the bracket. In order to provide a number of possible methods of installation for the hotplate, which is particularly important because of the position of the connecting leads, a plurality of recesses 46 may be provided on the circumference, optionally also offset by 90° relative to one another. The fact that the anti-rotation rod 45 is mounted on the bracket instead of on the hotplate as before means that the overall dimensions of depth of the hotplate are kept small. The recess 46 is closed off so that the hot inner space 48 of the hotplate formed between the covering sheet 24 and the hotplate member 12 is sealed off.

Figure 3:
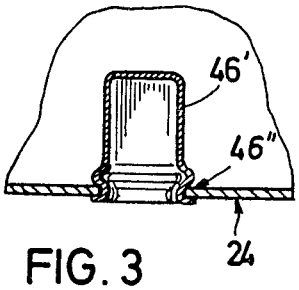
FIG. 3 is a section through an alternative embodiment of a detail from FIG. 1.

FIG. 3 shows an alternative embodiment for the recess 46 which may be used if the sheet metal from which the covering plate 24 is made should not be subjected to any great deformation. A separately produced sleeve 46' is tightly secured in an opening in the covering sheet 24 by means of a two-sided flange 46''. It is also possible to provide the sleeve, in the region of the flange 46'', for example, with a pressed-in thread for the subsequent screwing-in of a rod.

Figure 4:
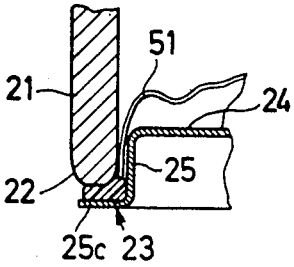
FIG. 4 shows the detail indicated by the dash-dot circle IV in FIG. 1, on a larger scale.
Figure 5:
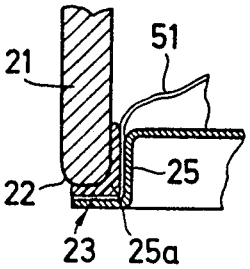
FIGS. 5 to 7 show alternative embodiments of the detail shown in FIG. 4.
Figure 6:
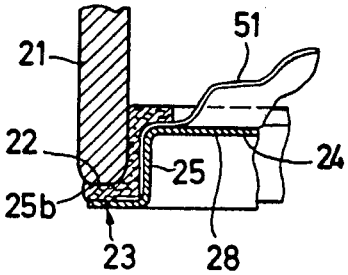

FIG. 4 shows a detailed view wherein a sealing ring **25*c*, which may be flat or circular in cross section and which is made of a heat-resistant sealing material, is inserted between the border region 23 of the covering sheet 24 and the lower edge 22 of the hotplate border 21. Suitable materials for the sealing ring 25*c* include silicon rubber, asbestos-containing sealing materials, etc. Other embodiments of seals are shown in FIGS. 5 and 6, the seal 25*a* in FIG. 5 consisting of a paste which is introduced into the angle between the border region 23 and the step 25 and spreads over the lower edge 22 and the inside of the border 21 when pressure is applied. This embodiment provides a particularly advantageous method of sealing in the region of the recess 26**.

FIG. 6 shows, at the corresponding point, a prefabricated sealing ring **25*b* of Z-shaped cross section which covers the lower edge 22, the inside of the border 21 and part of the inner surface of the recessed portion 28 of the covering sheet 24**. This sealing ring may consist of a molding compound produced from an aluminasilicate fibre and impregnated with a lacquer based on silicon resin.

When a seal is used on the outer periphery it is also advisable to provide a seal in the region of the screw 32.

The seal is intended to prevent moisture from penetrating into the inner space 48 of the hotplate and thus possibly into the embedding mass 20 if the hotplate is exposed to extreme conditions, such as being transported by sea. Certainly, the hotplate will immediately repel any moisture which gets in, without producing any inadmissible leakage currents, but the seal provides an additional protection. The seal is established particularly by the abutment of the covering sheet on the lower flange, since this means that the seal is provided in a region of lower temperature and can be arranged better. Earlier covering sheets were placed on the underside of the embedding compound 20. The step 25 provides an additional seal and perfect centering.

Figure 7:
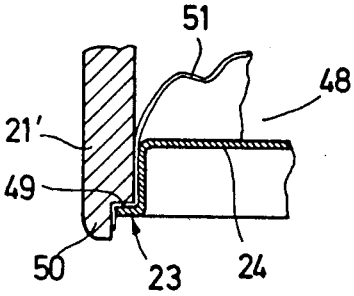

FIG. 7 shows an embodiment wherein the border 21' of the hotplate member comprises a step-shaped recess 49 on its inner underside so as to form an external continuous border portion 50 of the border 21' which extends somewhat further downwards than the abutment surface for the border region 23 of the covering sheet 24. This means that, if there is a risk of water running down under the hotplate, which can only happen in exceptional circumstances, the water will drip away without being sucked into the inner space 48 by capillary action.

FIG. 1 shows that a metal foil 51, more particularly a piece of bright crinkled aluminium foil, is located in the inner space parallel to the covering sheet. It is clamped between the border 21 and the covering sheet 24 or the seals provided (see FIGS. 4 to 7) and encloses, between itself and the covering sheet 24, a layer 52 which preferably consists of silica gel or kieselguhr or contains the latter. This material not only provides good insulation but also ensures that any moisture which has entered the inner space, e.g. as moisture from the air, is absorbed in the silica gel which acts as a drying agent. As a result of the automatic heating during operation of the hotplate, the drying agent is constantly regenerated automatically as the water is expelled and thus remains permanently effective. If a drying agent is used, it may be a good idea to perforate the metal foil or to place the drying agent in other containers in the inner space 48 to ensure that it is effective.

If there is no danger of any extreme conditions occuring as regards moisture levels, the layer 52 may be made from highly heat-resistant insulating materials such as inorganic fibres like asbestos or other known insulating materials. In conjunction with the metal foil located above, very effective insulation is obtained which further reduces any downward heat losses caused by radiation and convection, which are in any case very slight in contact-type hotplates. However, in particular this ensures that the temperature of the covering sheet 24 is kept low, so that the hotplate can be installed even in the flattest hobs near wooden parts of kitchen furniture.

Figure 10:
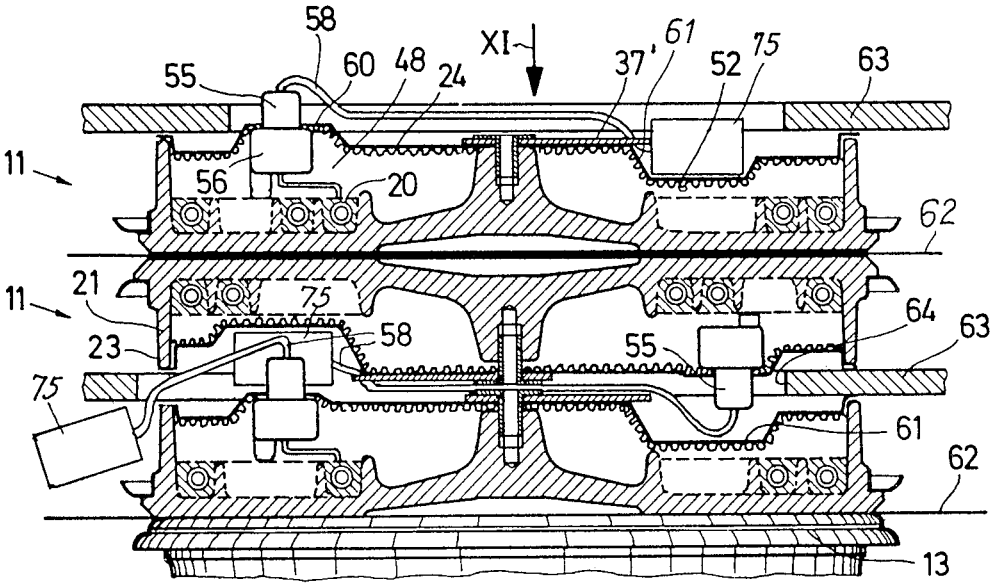
FIG. 10 shows three hotplates stacked one above the other, corresponding to the hotplate shown in FIG. 1, apart from the earth connection, and the associated packing means.
Figure 11:
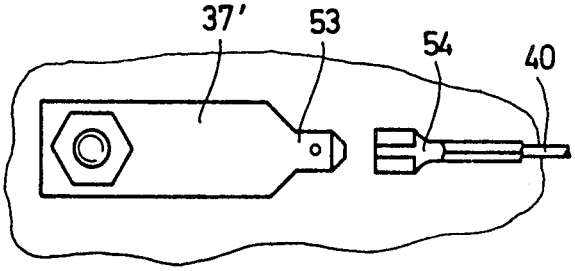
FIG. 11 shows a detailed plan view in the direction of the arrow XI in FIG. 10.

FIG. 10 shows three hotplates stacked one above the other; apart from the fact that the sheet metal part 37' (cf. FIG. 11) is provided with a flat insertion tongue 53 for the connection of a corresponding flat plug 54 for the earth lead 40, these hotplates are identical to the one shown in FIG. 1. Throughout the description, the same reference numerals have been used to denote identical parts. The direction of the section in FIG. 10 is offset by 45° relative to FIG. 1 so as to show that, projecting through the covering sheet 24, there is an insulating member 55 which rests inside the latter and contains a temperature limiting means 56 in its portion located in the inner space 48 and comprises continuous openings 57 (FIG. 15) arranged side-by-side, through which connecting leads 58, having a highly heat-resistant insulation, project out of the inner space 48 where they are welded to connecting pins projecting out of the embedding mass 20. The basic form of the insulating member is elongated in the circumferential direction and it projects through the covering sheet in the region of a bulge 60.

The connecting leads 58 are connected to a common connecting member 75 of ceramics insulating material (FIGS. 10 and 15) which contains plug-in or screw connection clips 76 for the connection of current feed lines 78. Owing to the arrangement of the insulating member in the radial direction substantially in the center of the annular heated zone and the dimensions of the connecting leads, the outer edge 77 of the connecting member 75 is preferably at most spaced from the outer edge thereof by a distance which is less than a radius of the hotplate and can flexibly be adapted to the particular conditions of installation, the connecting leads acting as a flexible strip which permits slight pivoting and greater mobility of the connecting member in the vertical direction but more strongly restricts rotation and lateral movement.

Diametrically opposite the insulating member 55 and at a corresponding radial distance from the center of the hotplate a depression 61 is provided in the covering sheet 24, the dimensions of which are such that it can safely receive the projecting portion of the insulating member in the mutual arrangement of the hotplate shown in FIG. 10, without the connecting leads 58 having to be bent too sharply. The width of the depression is substantially greater than that of the insulating member so that, as can be seen in FIG. 10 in the top two hotplates, the connecting leads 58 can be folded inwards and the connecting member 77 together with the insulating member can be placed in the depression 61. It is also possible to fold the connecting member 75 (bottom of FIG. 10) outwards and place it substantially in a plane with the hotplate, while the connecting leads 58 pass through a corresponding cutout in the packing plate 63.

Thanks to the despression in the covering sheet, it is possible to pack the hotplates in a particularly safe and space-saving manner for storage and dispatch. For this purpose, the hotplates are stacked one above the other with their central axes in alignment and with their flat cooking surfaces 13 and their undersides covered by the covering sheets 24 directed towards each other, while between the cooking surfaces 13, only a sheet or film 62 is inserted, to prevent scratches, and between the undersides of the hotplates a packing plate 63 is placed, which may consist of plywood or press-board and which has recesses designed so that the hotplate is centered when it is placed thereon. Parts of the hotplate projecting downwards relative to the outer edge 23 of the covering plate project into the recess 64 in the packing plate 63.

The hotplates 11 are offset by 180° relative to one another in the circumferential direction, so that the insulating member 55 with the connecting leads projects into the depression 61 and the hotplate even takes up less packing space than its own overall height. The borders 21 rest on one another, via the interposed packing plate 63, to form a firm stack with no tendency to tilt over. The aligned arrangement of the hotplates one above the other also particularly contributes to this. Depending on the desired packaging or pallet size, the packing plates 63 have a plurality of recesses 64 arranged side by side and behind one another so that a large number of hotplates can be stored and transported in a solid block; this not only saves storage and transporting costs but also gives greater protection against damage. Packing can also be carried out fully automatically by means of gripping devices.

The hotplates according to FIG. 10 do not have the silica gel filling. For insulation purposes only, crinkled aluminium foil 51 is placed parallel to the covering sheet 24.

Figure 14:
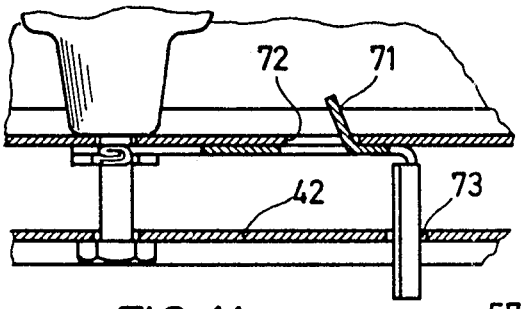
FIG. 14 shows a detailed section through the lower central region of a hotplate in the installed state.

FIGS. 12 to 15 show another apparatus for preventing the hotplate from rotating relative to the securing means, e.g. the bracket 42. For this purpose, a sheet metal part 65 in the form of a flat right-angled strip extends through in the region of the bend 66. Lateral indentations 67 form separate border areas at the ends of the portions 68, which are bent over or rolled round at the ends (cf. FIG. 13 in particular), so that the ends are in the form of pins. U-shaped cutouts 70 are provided in the portions 68 so as to form sheet metal tabs which are bent out from the plane of the portions 68. FIG. 14 shows this sheet metal part 65 in the installed position. Like the sheet metal part 37 in FIG. 1 it is secured to the hotplate by the screw 32 and is prevented from rotating thereon by the tab 71 which projects through an opening 72 in the hotplate. Instead of the opening 72 a corresponding embossed portion could also be provided so as not to perforate the covering sheet. Preferably, the ends 69 are not bent out through about 90° until the hotplate is installed in a cooker or the like; this bending is easily effected thanks to the indentations 67. Only the end 69 which is to be inserted in a hole 73 in the fixing bracket 42' has to be bent out. This, too, provides a protection against rotation without increasing the transporting space.

Figure 12:
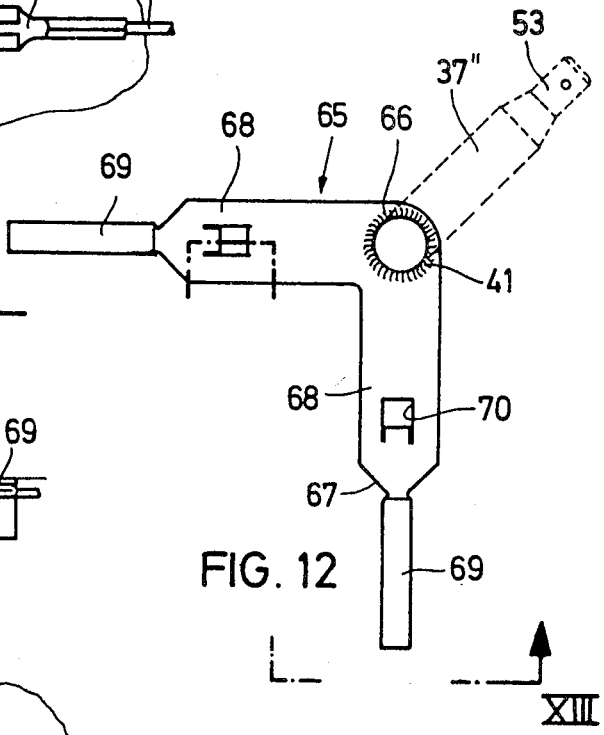
FIG. 12 shows a plan view of a sheet metal part used to prevent rotation and possibly act as an earth connection.
Figure 13:
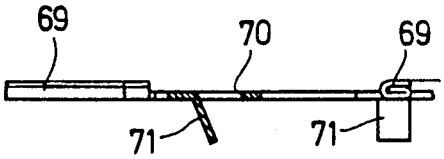
FIG. 13 shows a partially cut-away view on the line XIII—XIII in FIG. 12.
Figure 15:
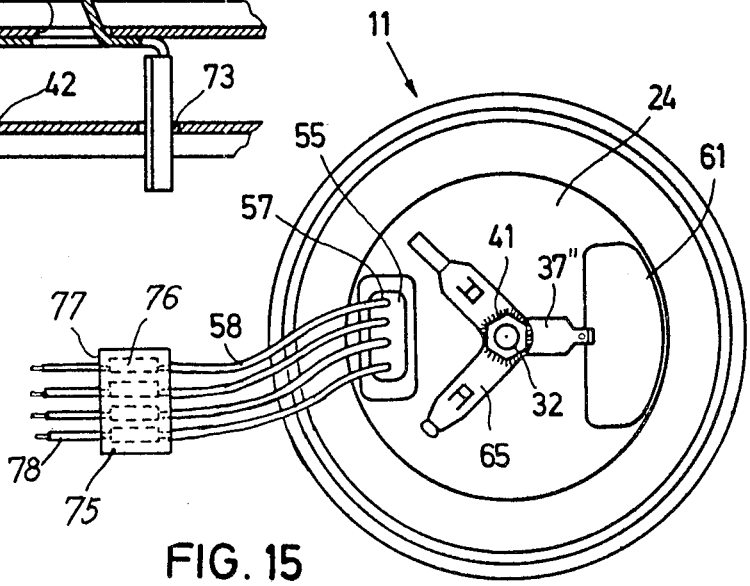
FIG. 15 shows a rear view of this hotplate.

FIG. 12 shows, by means of dash-dot lines, that the anti-rotation sheet metal part 65 may be provided with a third portion 37'' on whose end there is provided a flat insertion tongue 53 for the connection of an earth lead. In this way, one component can be used for a double function, namely preventing rotation and providing the earth connection. However, as shown in FIG. 15, it is also possible for the sheet metal part 37'' in addition to the anti-rotation part 65 to be screwed on by means of the screw 32. Since the part 65 is in any case prevented from rotating, radial grooves 41 on the latter are sufficient and none are needed on the covering sheet.

Since the hotplates are preferably packed in a position offset by 180°, the depression 61 is diametrically opposite the insulating member 55. Of course, it would also be possible to offset the hotplates by a different angle. The depression 61 would then also have to be offset by a different angle relative to the insulating member 55. In any case, the advantage of the covering sheet is that it is easy to produce owing to its not very great deformation, in spite of being sufficiently rigid, and it provides a sealed inner space which gives good insulation. In an embodiment having a central perforation for a central sensor cell, the cover could abut both on the outer border 21 and also on the inner edge surrounding the sensor recess, with a step, to follow the covering sheet. Here, again, hollow screws could be used for securing. In this case, therefore, the pin with the internal thread would, for example, not be located centrally but would be in the region of the outer border.

FIGS. 16 to 19 show a preferred embodiment of the invention. Hotplate 11, hotplate member 12 with heating coils 19 embedded in mass 20, rim 21, covering sheet 24 and insulating member 51 are shaped and positioned as shown and described with reference to FIGS. 1 and 10.

The ends of the heating coils are fastened to pins 80 projecting out of the ceramics mass 20. Solid wire leads 81 are welded to the pins and in order to provide electrical connections between some of the pins and forming part of the supply lines of the hot plate. Leads 81 project through openings 57 which are arranged side-by-side in the insulating member 51. Outside the insulating member 51 the leads are butt-welded to flexible stranded connection wires 58, which are surrounded by temperature resistant insulation sleeves 82.

In a distance as described before with reference to FIG. 15 each free end of each flexible wire 58 is inserted into a channel 83 of a connecting member 75'. The channels 82 are arranged side-by-side and consist of holes penetrating the connecting member 75', which is fabricated of electrically insulating material and has the shape of a bar arranged transversely to the wires 58 and connecting the mechanically as to form a band or strip. Each of the holes is of circular cross-section and has a portion 84 of larger diameter and a portion 85 of smaller diameter with a shoulder 86 inbetween. At the mouth of the portion 85 of the holes there are two lateral recesses 87 in the front face 91 of the connecting member 75'.

Each free end of the wire 58 is provided with an end-splice 90 consisting of a sheet metal sleeve 88 which surrounds the end of the wire strand and an insulation gripping lug 89 which surrounds the end of the insulating sleeve. The end-splice 90 is formed from sheet metal which is bent first into the cross-section shape of an U. The wire strand is inserted into the U which is thereafter closed to form an O containing the strand (as shown in FIG. 18). The also U-shaped insulation gripping lug is pressed tightly around the insulating sleeve 82.

If the end-splice is now inserted into the channel 83, the insulation grip 89 abuts at shoulder 86, thereby positioning the end-splice in lengthwise direction. The sleeve portion 88 passes through the narrower part of the channel but projects with its longer part over the face 91. After insertion the final forming of the sleeve portion 88 is carried out in its portion projecting over face 91. Thereby the sleeve is formed into the kidney shape as shown in FIG. 19 which is broader, but lower than the previous circular shape (FIG. 18). It can be seen from FIG. 19 that lateral portions of the sleeve 88 are pressed into the recesses securing the end-splice as well against being thrown out of the channel as against rotation. The sleeve portions 88 of the end-splices 90 thereby form connector plugs, which can be inserted into any socket and fastened there by means of screws, springs or the like.

In FIG. 16 there is shown a socket 191 of insulating material containing internal chambers which are accessable through openings from both sides and into each of which a metal cage 92 is inserted which houses a double spring clip 93 of C-shape, one free end 94 of which is sharply cut, while the other end 95 is bent to the inside. If sleeve or plug 88 is inserted from one side and a lead wire 96 from the other side both of them are clipped and fixed in electrical conducting relationship by being pressed to the bottom of the cage 92 by the spring clip which is self-locking at its sharp end 94. At its bent end 95 it snaps into a transverse groove 98 pressed into the sleeve portion 88, which provides a sufficiently strong connection, but, if one tries to pull the wires out of the socket from both sides, only the sleeve portion 88 will be drawn out. It is therefore impossible that the uninsulated free end of current carrying supply line 96 will be exposed.

It can be seen, that by the invention, the free ends of the flexible connection wires are attached into a multiple plug which can easily be connected to a socket or single spring or screw clips. The plugs are held perfectly aligned parallel to each other and with the flat sides of the sleeve pointing in the desired direction. It is possible to provide a lug 99 projecting out of the face 91, which cooperates with a corresponding recess in the socket housing, to prevent connection of wrong lines. This can also be accomplished by different unsymmetrical orientation of the sleeve portions 88. It is possible to use end-splices in which portions forming the plugs do not consist of wire surrounded by a sleeve, but of sheet metal tongues.

We claim:

1. An electric hotplate, comprising:

a hotplate member;

electrical heating resistor means for heating at least a zone of said hotplate member;

a covering sheet covering at least the underside of the heated zone of said hotplate, including said heating resistor means, the sheet having an opening therethrough;

a plurality of flexible, thermally and electrically insulated electrical connection means, each being electrically connected at one end to said heating resistor means and extending through said opening for connecting said heating resistor means to a source of electrical energy;

a connecting member for mechanically connecting said flexible electrical connection means to one another near their other ends, said connecting member being freely movable relative to said hotplate member in all directions, limited only by the length of said electrical connection means;

said covering sheet having an upwardly projecting depression angularly displaced from said opening and sufficiently large to accommodate said connecting member during transport; and, said flexible electrical connection means being of sufficient length to enable the connecting member to be operationally mounted outside the region of the hotplate after transport.

2. An electric hotplate according to claim 1, further comprising an insulating member inserted into said opening and having passages therethrough for said electric connection means, said insulating member projecting downwardly beyond the covering sheet.

3. An electric hotplate according to claim 2, wherein the the depression and the insulating member are equally radially spaced from the center of the covering sheet but angularly displaced from one another.

4. An electric hotplate according to claim 3, wherein the depression is sufficiently larger than the insulating member to accomodate a connecting member as well.

5. An electric hotplate, comprising:

a hotplate member;

electrical heating resistor means for heating at least a zone of said hotplate member;

a covering sheet covering at least the underside of the heated zone of said hotplate, including said heating resistor means, the covering sheet having an opening therethrough;

a plurality of flexible, thermally and electrically insulated electrical connection means, each being electrically connected at one end to said heating resistor means and extending through said opening for connecting said heating resistor means to a source of electrical energy; and, a connecting member for mechanically connecting said flexible electrical connection means to one another near their other ends, including clamping means for mechanically clamping the flexible electrical connection means near their free ends and holding them parallel to one another, said clamped free ends forming connector plug means, said connecting member and said connector plug means formed thereby being freely movable relative to said hotplate member in all directions, limited only by the length of said electrical connection means, said flexible electrical connection means being of sufficient length to enable the connecting member to be operationally mounted outside the region of the hotplate.

6. An electric hotplate according to claim 5, wherein the connecting member includes connecting clips for connecting the flexible connection means to the source of electrical energy.

7. An electric hotplate according to claim 5, wherein the connecting member holds the flexible connection means in side-by-side relationship.

8. An electric hotplate according to claim 5, wherein the hotplate member is substantially circular and the length of the flexible connection means is such that the operational mounting of the connecting member can be at any distance from the border of the hotplate member which is less than the radius of the hotplate member.

9. An electric hotplate according to claim 5, wherein the flexible electrical connection means comprises several separate wires welded to connecting pins of the hotplate.

10. An electric hotplate according to claim 5, wherein the connector plug means are oriented so as to be insertable into a socket means and being so shaped as to be insertable into the socket means in only one direction.

11. An electric hotplate according to claim 5, wherein the connecting member comprises channels, the ends of the flexible connection means inserted therein being secured in the channels and fastened by deformation of said ends.

12. An electric hotplate according to claim 11, wherein the channels in the connecting member are apertures having an internal shoulder for engagement of a corresponding shoulder provided near the ends of the flexible electric connection means.

13. An electric hotplate according to claim 11, wherein the flexible connection means comprise stranded wires having ends surrounded by multicore cable end-splices.

14. An electric hotplate according to claim 13, wherein the end-splices are formed into their final shape after being inserted into said channels.

15. An electric hotplate according to claim 14, wherein the connecting member comprises recesses into which parts of said end-splices are inserted during formation of the end-splices.

16. An electric hotplate according to claim 5, wherein said connector plug means cooperate with socket means, which comprise spring clip means for gripping and holding the connector plug means as well as leads leading to the source of electrical energy, wherein said spring clip means are self-locking for said leads and not self-locking for said connector plug means.

17. An electric hotplate according to claim 5, further comprising an insulating member inserted into said opening and having passages therethrough for said electrical connection means.

18. An electric hotplate according to claim 17, wherein the insulating member is disposed radially closer to the border of the hotplate member than to the center thereof.

19. An electric hotplate according to claim 17, wherein the heated zone is of annular shape and the insulating member is substantially centered between the inner and outer radial edges of the heated annular zone.

* * * * *